United States Patent [19]

Ratell

[11] Patent Number: 4,647,896

[45] Date of Patent: Mar. 3, 1987

[54] MATERIALS FOR PACKAGING CIRCUIT PROTECTION DEVICES

[75] Inventor: Joseph M. Ratell, Fremont, Calif.

[73] Assignee: Raychem Corporation, Menlo Park, Calif.

[21] Appl. No.: 711,908

[22] Filed: Mar. 14, 1985

[51] Int. Cl.[4] ..... H01C 7/10

[52] U.S. Cl. ..... 338/22 R; 338/20; 338/319

[58] Field of Search ..... 338/20, 21, 22 R, 22 SD, 338/319

[56] References Cited

U.S. PATENT DOCUMENTS 4,481,498 11/1984 McTavish et al. ..... 338/20

FOREIGN PATENT DOCUMENTS 0038713 4/1971 European Pat. Off. .
831490 3/1960 United Kingdom .
1041503 9/1966 United Kingdom .

*Primary Examiner*—E. A. Goldberg
*Assistant Examiner*—M. M. Lateef
*Attorney, Agent, or Firm*—Timothy H. P. Richardson; Herbert G. Burkard; Stephen C. Kaufman

[57] ABSTRACT

Circuit protection devices which have a PTC conductive polymer element and an enclosure which is spaced apart from the PTC element and at least a part of whose interior surface is composed of a material which has an oxygen index of at least 70 and has a thermoset polymer, preferably an alkyd resin, and a filler, such as alumina trihydrate, which, when heated in the absence of air, decomposes to give a gaseous by-product.

20 Claims, 1 Drawing Figure

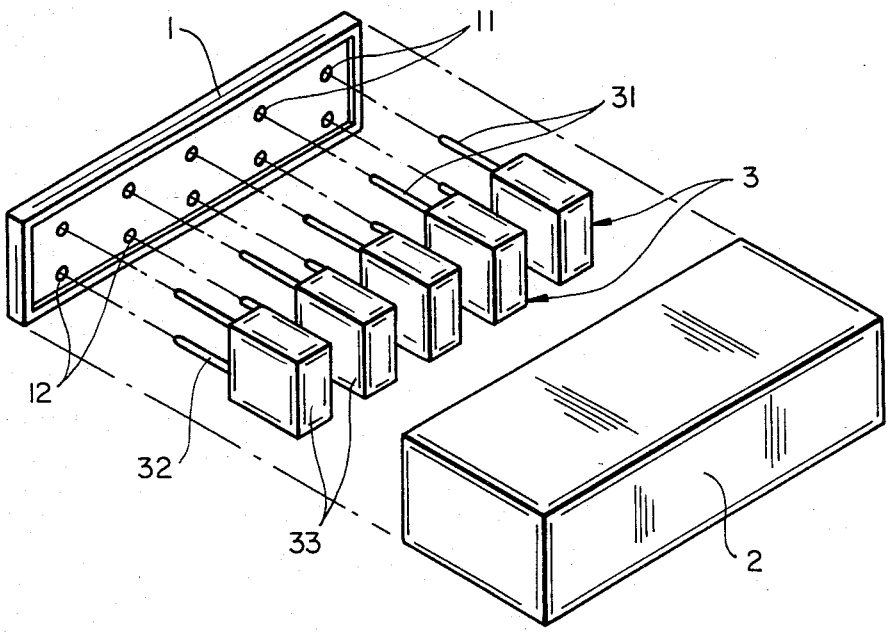
1
11
31
3
12
32
33
2

MATERIALS FOR PACKAGING CIRCUIT PROTECTION DEVICES

BACKGROUND OF THE INVENTION

1. Field of the Invention

This invention relates to circuit protection devices comprising PTC conductive polymer elements.

2. Introduction to the Invention

Conductive polymer compositions exhibiting PTC behavior, and electrical devices comprising them, are well known. Reference may be made, for example, to U.S. Pat. Nos. 2,952,761; 2,978,665; 3,243,753; 3,351,882; 3,571,777; 3,757,086; 3,793,716; 3,823,217; 3,858,144; 3,861,029; 3,950,604; 4,017,715; 4,072,848; 4,085,286; 4,117,312; 4,177,376; 4,177,446; 4,188,276; 4,237,441; 4,242,573; 4,246,468; 4,250,400; 4,252,692, 4,255,698, 4,271,350, 4,272,471, 4,304,987, 4,309,596, 4,309,597, 4,314,230, 4,314,231, 4,315,237, 4,317,027, 4,318,881, 4,327,351, 4,330,704, 4,334,351, 4,352,083, 4,388,607, 4,398,084, 4,413,301, 4,425,397, 4,426,339, 4,426,633, 4,427,877, 4,435,639, 4,429,216, 4,442,139, 4,459,473, 4,473,450, 4,502,929, 4,514,620, 4,534,889, 4,542,365, 4,545,926, 4,548,662, 4,549,161, 4,562,313, 4,571,481, 4,574,188 and 4,582,983. This disclosure of each of the patents referred to above is incorporated herein by reference.

Particularly useful devices comrising PTC conductive polymers are circuit protection devices. Such devices have a relatively low resistance under the normal operating conditions of the circuit, but are "tripped", i.e., converted into high resistance state, when a fault condition, e.g., excessive current or temperature, occurs. When the device is tripped by excessive current, the current passing through the PTC element causes it to self-heat to an elevated temperature at which it is in a high resistance state. The increase in resistance is accompanied by an expansion of the PTC element along an expansion axis. Such devices, and PTC conductive polymer compositions for use in them, are described for example in U.S. Pat. Nos. 4,237,411, 4,238,812; 4,255,698; 4,315,237; 4,317,027; 4,329,726; 4,352,083; 4,413,301; 4,450,496; 4,475,138; 4,481,498; and 4,562,313; and in copending commonly assigned patent applications Ser. Nos. 141,989, 628,945, 711,907, 711,909, 711,910 and 711,790. The disclosure of each of these patents and pending applications is incorporated herein by reference.

SUMMARY OF THE INVENTION

I have been working on the use of circuit protection devices containing PTC conductive polymer elements in situations in which the device is mounted onto, or itself comprises, a wall which is spaced apart from the PTC element and through which the electrodes pass. The wall is usually part of an enclosure which encloses and is spaced apart from the PTC element. The wall can be associated with a plurality of protection devices whose electrodes pass through the wall. In my work I have found that the materials which have hitherto been used for such walls do not give satisfactory results under test conditions which are designed to simulate actual fault conditions which may occur, for example when the device is used to provide secondary protection in subscriber loop interface circuits in telecommunications systems.

I have found that improved results can be obtained, not only under the test conditions in question but also under other conditions, if the wall through which the electrodes pass is composed of a material which (a) comprises a thermoset polymer and, dispersed in the polymer, a filler which, when heated in the absence of air, decomposes to give a gaseous by-product, and (b) has an oxygen index of at least 70.

In a first aspect, this invention provides a circuit protection device which comprises (1) a PTC element composed of a conductive polymer composition which exhibits PTC behavior and which comprises a polymeric component and, dispersed in the polymeric component, a particulate conductive filler comprising carbon black;

(2) two electrodes which are electrically connected to the PTC element and which are connectable to a source of electrical power to cause current to pass through the PTC element; and (3) an enclosure which encloses and is spaced apart from the PTC element; through which the electrodes pass; and at least a part of whose interior surface is composed of a material which (a) comprises a thermoset polymer and, dispersed in the thermoset polymer, a filler which, when heated in the absence of air, decomposes to give a gaseous by-product, and (b) has an oxygen index of at least 70.

BRIEF DESCRIPTION OF THE DRAWING

The invention is illustrated in the accompanying drawing, in which the FIGURE is an exploded perspective view of apparatus according to the invention.

DETAILED DESCRIPTION OF THE INVENTION

The thermoset polymers which are used in the present invention are preferably unsaturated polyester resins, particularly alkyd resins. Such resins are well known to those skilled in the art and are commercially available. Reference may be made for example to Modern Plastics Encyclopedia, 1981–2, pages 54 and 55. A polyester which includes a high proportion of aromatic groups in its backbone is desirable. Preferably at least one, particularly both, of the acid precursor and the hydroxy precursor of the polyester contains an aromatic radical.

The fillers which are dispersed in the thermoset polymers are particulate materials which when heated in the absence of air, will decompose to give a gaseous by-product, e.g. one or more of $H_20$, $C0_2$ or $N_2$. Suitable fillers include hydrated inorganic materials, e.g. fully partially hydrated metal oxides (this term being used to include materials which consist of or contain the corresponding metal hydroxide), for example alumina trihydrate and partial dehydration products thereof. As noted in U.S. Pat. No. 4,481,498, failure of protection devices based on PTC elements comprising carbon black dispersed in a polymer can result from the formation of a conductive path between the elecrodes, as a result of the deposition of cabonaceous dust, evolved from the PTC element when it is tripped, onto a surface which joins the electrodes. I theorize that the fillers used in the present invention help to prevent the formation of such conductive paths because, when an arc is struck between the electrodes, via the carbon dust on the surface, the filler decomposes to give a gas which quenches the arc and/or blows the carbon dust away, and thus prevents the formation of a permanent low resistance conductive path between the electrodes. I believe that in the resins that I have tested, the filler is a hydrated inorganic material, e.g. a hydrated metal oxide, probably alumina trihydrate. The amount of the filler is generally at least 30%, e.g. 35 to 45%, by weight of the material.

It is essential that the material comprising the thermoset polymer and the filler has an oxygen index (as measured by ASTM D-2863) of at least 70, preferably at least 80, particularly at least 90. It is preferred that the material can be injection molded, since the precise configuation of the interior of the container can influence the performance of the device, and preferred configurations are most easily produced by injection molding. I have obtained excellent results using the alkyd resin sold by Occidental Chemical Corp. under the trade name Durez 27962; another useful resin, though it does not mold as well as Durez 27962, is the polyester resin sold by Polyply Inc. under the trade name Polyply 453. On the other hand the polyester resins sold by Plastics Engineering Co. under the trade names Plenco 1581 and 1535 and by Premix Inc. under the trade name Premidry 3130, are not satisfactory. Contrary to the teaching of U.S. Pat. No. 4,481,498, the materials useful in this invention do not, or least do not necessarily, pass the carbon burn-off test described in U.S. Pat. No. 4,481,498.

In order for the benefits of this invention to be obtained, the filled thermoset polymer must form at least a part of the surface over which a low resistance carbonaceous path is most likely to form during use of the device. Generally, the material will provide at least part, and preferably all, of the surface which lies between the electrodes. Generally the wall through which the electrodes pass will consist essentially of the material. Preferably the whole of the container around the PTC element will be fabricated from the material, preferably by injection molding.

Referring now to the drawing, this shows a container which comprises a wall portion 1 having pairs of exit ports 11, 12 passing therethrough and a cover portion 2 which can be fitted to the wall portion 1. The container is composed of an injection-molded filled thermoset polymer as defined above. The apparatus also includes five identical circuit protection devices 3, each comprising a pair of electrodes 31 and 32 which are embedded in a PTC conductive polymer element 33 and extend therefrom and fit through the exit ports 11 and 12 in the wall portion 1.

I claim:

1. A circuit protection device which comprises (1) a PTC element composed of a conductive polymer composition which exhibits PTC behavior and which comprises a polymeric component and, dispersed in the polymeric component, a particulate conductive filler comprising carbon black;

(2) two electrodes which are electrically connected to the PTC element and which are connectable to a source of electrical power to cause current to pass through the PTC element; and (3) an enclosure which encloses and is spaced apart from the PTC element; through which the electrodes pass; and at least a part of whose interior surface is composed of a material which (a) comprises a thermoset polymer and, dispersed in the thermoset polymer, a filler which, when heated in the absence of air, decomposes to give a gaseous by-product, and (b) has an oxygen index of at least 70.

2. A device according to claim 1 wherein said material has an oxygen index of at least 80.

3. A device according to claim 1 wherein said material has an oxygen index of at least 90.

4. A device according to claim 1 wherein said filler, when heated in the absence of air, decomposes to give $H_20$.

5. A device according to claim 4 wherein said filler is alumina trihydrate.

6. A device according to claim 1 wherein said filler, when heated in the absence of air, decomposes to give $C0_2$ or $N_2$.

7. A device according to claim 1 wherein said material comprises at least 30% by weight of said filler.

8. A device according to claim 7 wherein said thermoset polymer is an alkyd resin.

9. A device according to claim 7 wherein said thermoset polymer is a polyester resin in which at least one of the acid precursor and the hydroxy precursor comprises an aromatic group.

10. A device according to claim 1 wherein at least those parts of the enclosure through which the electrodes pass consist essentially of said material.

11. A device according to claim 1 wherein said enclosure consists essentially of said material.

12. A device according to claim 1 wherein said material has been shaped by injection molding.

13. A circuit protection device which comprises (1) a PTC element composed of a conductive polymer composition which exhibits PTC behavior and which comprises a polymeric component, and dispersed in the polymeric component, a particulate conductive filler comprising carbon black;

(2) two electrodes which are electrically connected to the PTC element and which are connectable to a source of electrical power to cause current to pass through the PTC element; and (3) a wall which is spaced apart from said PTC element and which contains two exit ports, through each of which passes one of said electrodes, the surface of said wall adjacent the PTC element consisting essentially of a material which (a) comprises a thermoset polymer and, dispersed in the thermoset polymer, a filler which, when heated in the absence of air, decomposes to give a gaseous by-product, and (b) has an oxygen index of at least 70.

14. A device according to claim 13 wherein said wall consists essentially of said material.

15. A device according to claim 14 wherein said material has been shaped by injection molding.

16. A device according to claim 13 wherein said wall is part of an enclosure which encloses and is spaced apart from the PTC element.

17. A device according to claim 13 wherein said material has an oxygen index of at least 90 and contains at least 30% by weight of a filler which is a hydrated inorganic material.

18. Apparatus which comprises (A) a plurality of circuit protection devices, each of which comprises (1) a PTC element composed of a conductive polymer composition which exhibits PTC behavior and which comprises a polymeric component and, dispersed in the polymeric component, a particulate conductive filler comprising carbon black; and (2) two electrodes which are electrically connected to the PTC element and which are connectable to a source of electrical power to cause current to pass through the PTC element; and (B) an enclosure which encloses and is spaced apart from the PTC elements of the protection devices and which comprises a wall containing a plurality of exit ports through each of which passes one of the electrodes of the circuit protection devices, the wall being composed of a material which (a) comprises a thermoset polymer and, dispersed in the thermoset polymer, a filler which, when heated in the absence of air, decomposes to give a gaseous by-product, and (b) has an oxygen index of at least 80.

19. Apparatus according to claim 18 wherein the enclosure consists essentially of said thermoset polymer.

20. Apparatus according to claim 19 wherein the thermoset polymer is an alkyd resin and the material has been shaped by injection molding, has an oxygen index of at least 90 and contains at least 30% by weight of a filler which is a hydrated inorganic material.

* * * * *